US006314976B1

(12) United States Patent
Clarke

(10) Patent No.: US 6,314,976 B1
(45) Date of Patent: Nov. 13, 2001

(54) UMBRELLA FRAME

(75) Inventor: Dougan H. Clarke, Miami, FL (US)

(73) Assignee: Tucci Engineering & Design, Inc., Miami, FL (US)

( * ) Notice: Subject to any disclaimer, the term of this patent is extended or adjusted under 35 U.S.C. 154(b) by 0 days.

(21) Appl. No.: 09/330,600

(22) Filed: Jun. 11, 1999

(51) Int. Cl.[7] ..... A45B 25/02

(52) U.S. Cl. ..... 135/28; 135/29; 135/32; 403/217; 403/170

(58) Field of Search ..... 135/98, 99, 15.1, 135/20.3, 25.31, 28, 29, 32, 33.6, 38, 41, 30; 403/157, 391, 397, 217, 170, 174; 211/179

(56) References Cited

U.S. PATENT DOCUMENTS

| | | | | |
|---|---|---|---|---|
| D. 25,368 | | 4/1896 | Sparry . | |
| D. 56,043 | | 8/1920 | Weinberg et al. . | |
| 1,328,175 | * | 1/1920 | Martin | 135/29 X |
| 2,336,116 | | 12/1943 | Morando . | |
| 3,177,882 | | 4/1965 | Militano . | |
| 3,424,180 | | 1/1969 | Andolfi . | |
| 4,368,749 | | 1/1983 | Lindler et al. . | |
| 4,834,126 | | 5/1989 | Sweet, Jr. . | |
| 5,020,557 | | 6/1991 | Apple . | |
| 5,193,566 | * | 3/1993 | Chen | 135/28 |
| 5,398,709 | * | 3/1995 | Lee | 135/28 |
| 5,640,984 | * | 6/1997 | Dubunsky | 135/33.2 |
| 5,715,853 | | 2/1998 | Lin . | |
| 5,836,328 | * | 11/1998 | Lee | 135/29 X |
| 5,871,024 | * | 2/1999 | Vanderminden, Sr. | 135/98 X |
| 6,076,540 | * | 6/2000 | You | 135/28 X |

* cited by examiner

*Primary Examiner*—Winnie S. Yip
(74) *Attorney, Agent, or Firm*—Malloy & Malloy, P.A.

(57) ABSTRACT

An umbrella frame provides a stable and enduring support for an umbrella canopy while also allowing canopies of varying shapes and sizes to be mounted thereto. The umbrella frame includes a pair of hub members mounted about a pole member wherein each hub member has a plurality of slots formed in its outer perimeter. Ribs and struts are pivotally secured to the hub members using hub connectors which are removably secured to the hub slots so as to allow the size and shape of the attached canopy to be readily varied. The struts are also pivotally secured to the ribs by a collar member which helps prevent damage to the overlying canopy. The umbrella frame is rotatable about its axis in both the extended and retracted positions.

22 Claims, 5 Drawing Sheets

UMBRELLA FRAME

FIELD OF THE INVENTION

This invention relates to umbrellas, and more particularly to a durable and versatile umbrella frame for encountering abusive weather conditions.

BACKGROUND AND SUMMARY OF THE PRESENT INVENTION

Outdoor umbrellas are employed to shield people from the sun, wind, rain, and other elements of nature. As such, they are intentionally designed to withstand these elements. Nevertheless, damage to the framework of an umbrella can and does occur for many reasons, particularly to umbrellas in geographical areas of severe and unexpected weather, as well as umbrellas which have been improperly installed. Many prior art umbrellas suffer the disadvantages of not being able to withstand harsh weather as well as not being capable of simple repair when damage does occur. For example, an umbrella having static wire, rigid line and an unbalanced construction at the rib and strut pivot point will wear and often break when extreme forces are applied over time. Because the static or rigid line connects a plurality of ribs and struts at the upper and lower central hubs, any compromise of this entity will mean the collapse of the entire canopy assembly. Further, once an umbrella is damaged, it is often more expensive and difficult to repair the umbrella than to have it replaced.

For umbrellas having individual pivotal connections between the upper rib and lower strut assembly, the unbalanced nature of the movement at the pivot point in relation to the upper and lower central hubs causes unnecessary wear on the pivot junction as well as to the static wire or rigid line which connects the canopy rib assembly to the central hubs. This wear is undesirable and is aggravated over time by the stresses of both man and nature.

For umbrellas having individual pivotal connections between the upper rib and lower strut assembly by means of a vertically configured bracket individually, the existing plastic brackets protrude over the top of the canopy assembly providing a point of friction between the fabric of the canopy and the rigid protrusion of the pivot bracket. This creates excessive wear on a fabric canopy and often creates holes in the fabric canopy.

Various umbrella frames are described, for example, in the following U.S. Pat. Nos.: D25,368 to Sparry; D56,043 to Weinberg et al.; U.S. Pat. No. 2,336,116 to Morando; U.S. Pat. No. 3,177,882 to Militano; U.S. Pat. No. 4,368,749 to Lindler et al.; U.S. Pat. No. 4,834,126 to Sweet, Jr.; and U.S. Pat. No. 5,715,853 to Lin. None of these umbrella frames shows the connection of a central hub with a secondary hub in a manner which allows for the quick exchange of components so as to allow the customization of the size and shape of the canopy member atop the umbrella frame.

By the present invention, there is provided a durable outdoor umbrella frame that will withstand extreme forces and that may be quickly, easily and inexpensively repaired. The present invention is also easily modified to accommodate umbrella canopies of different sizes and shapes. The present invention includes a pair of hub members having a set of slots about their radial edges for receiving a combination of hub connector joints. A matching number of ribs and struts are pivotally secured to each hub by these joints, and the struts are pivotally secured to the ribs by collar members. The hub connector joints and the collar members are easily mounted and replaced, and assist in the smooth operation of the umbrella frame. Additionally, the collar members maintain a low profile so as to avoid contacting and thereby potentially damaging a mounted canopy.

It is thus one object of the present invention to provide an umbrella frame which can be easily manipulated to allow the attachment of canopies of varying shapes and sizes.

It is another object of the present invention to provide an umbrella frame capable of withstanding extreme temperature, wind and other weather conditions.

It is a further object of the present invention to provide an umbrella frame capable of simple rotation.

It is another object of the present invention to provide an umbrella frame having easily replaceable and interchangeable parts.

DETAILED DESCRIPTION OF THE PREFERRED EMBODIMENTS

Figure 1:
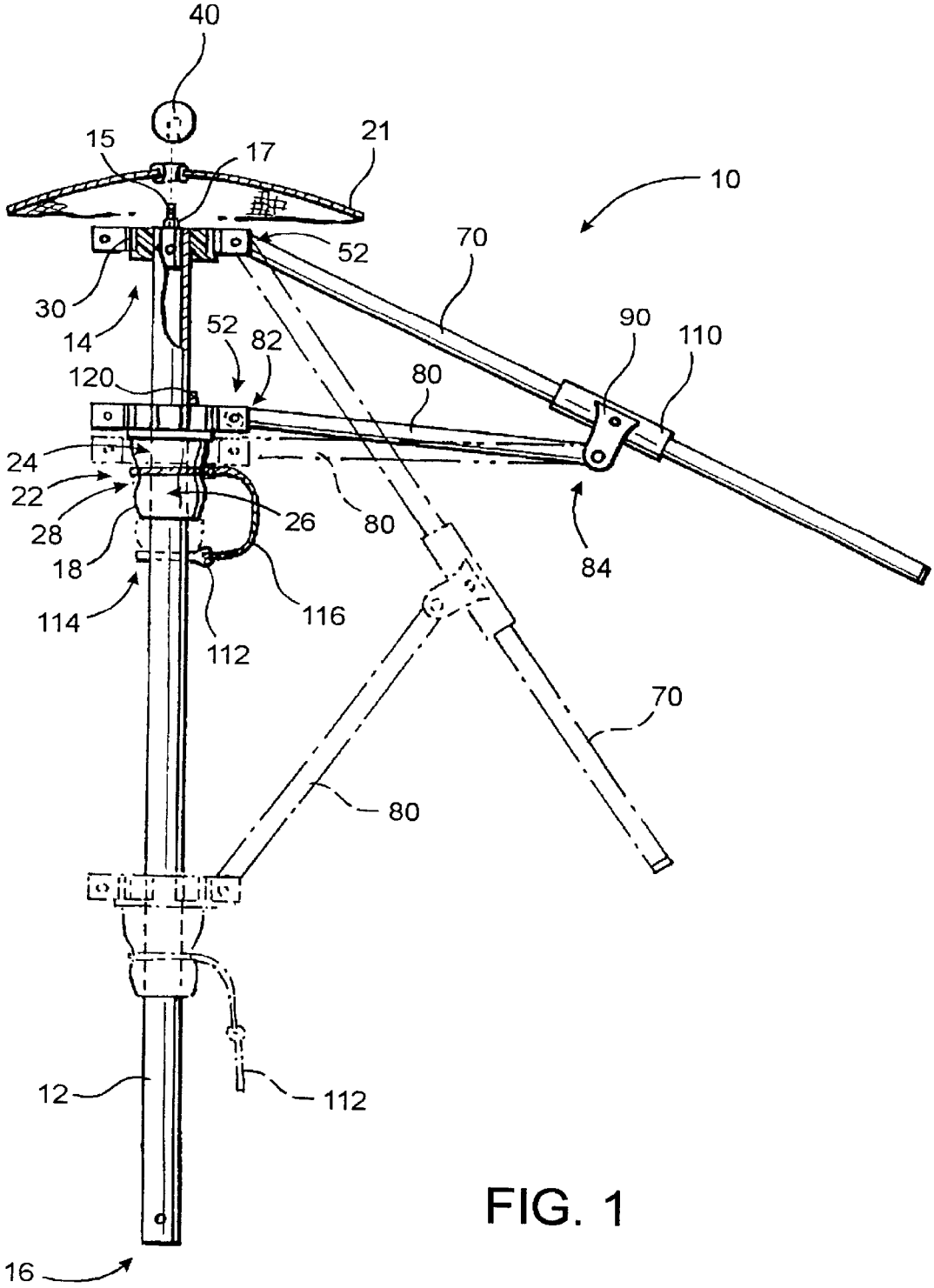
FIG. 1 is a partial exploded front elevational view in partial cross-section of the umbrella frame assembly of the present invention, with different positions of the frame assembly shown in phantom and dashed lines.
Figure 2:
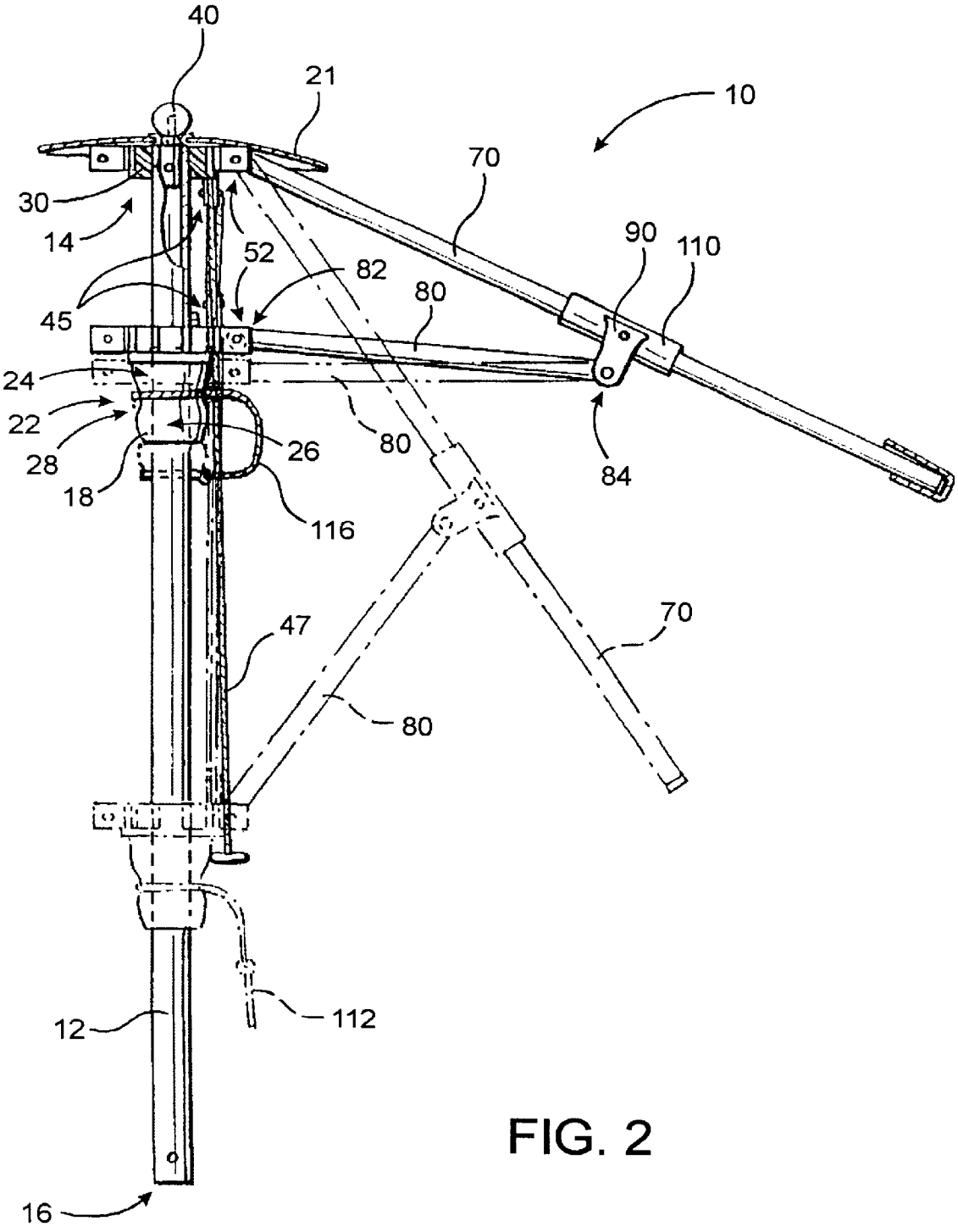
FIG. 2 is a partial front elevational view in partial cross-section of the umbrella frame assembly of the present invention, shown with a double pulley system installed.

As shown in FIGS. 1 through 9, there is provided an umbrella frame assembly 10 for use in easily and quickly supporting a variety of shapes and sizes of umbrella canopies. The frame assembly 10 is durable and weather resistant, and includes a longitudinally extending pole member 12 which can be made of wood, aluminum or other material. In one embodiment, the pole member is made of 40 gauge aluminum. The pole member 12 has a top end 14 and a bottom end 16. The bottom end 16 may be easily secured to the ground or any means of vertical affixment or, a reinforced concrete base, for example, such as one having a star knob and hitch pin. A main hub member 18 having a central cavity 20 extending axially therethrough is secured about the central pole member and is slidable between the top 14 and bottom 16 ends of the pole member. The main hub member 18 is also capable of rotating about the pole member axis. In one embodiment of the invention, as shown in FIGS. 1 and 2, the main hub member 18 is provided with a substantially "hour glass" shaped base portion 22 having upper 24 and lower 26 portions and a waist portion 28 which is of smaller diameter than the upper and lower portions. The base portion shape allows for simple hand manipulation of the hub member 18 up and down the pole member.

Figure 3:
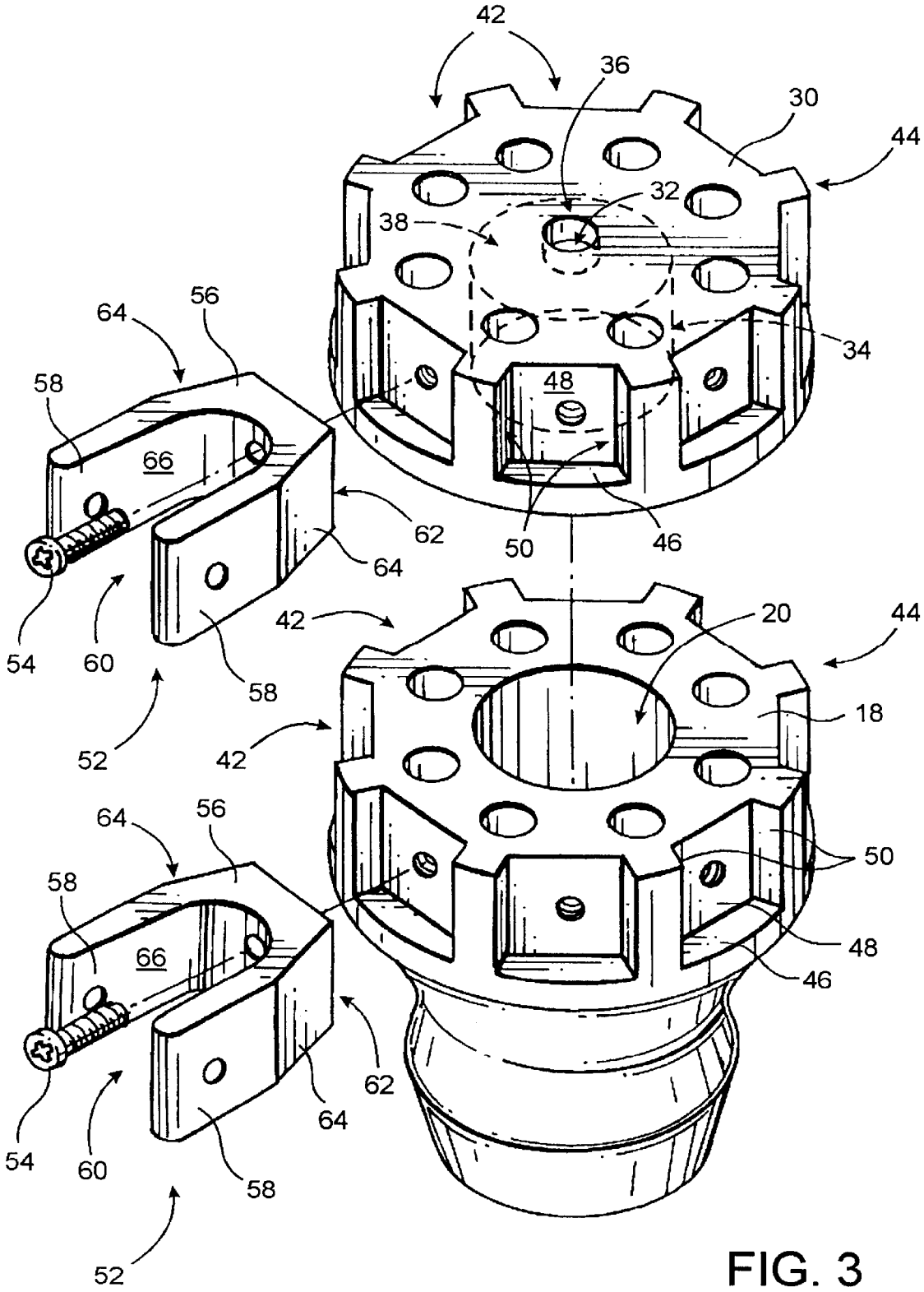
FIG. 3 is an exploded perspective view of the hub members of the present invention, showing the hub connector joints.

As shown in FIGS. 1 through 3, an upper or secondary hub member 30 is provided near the top end 14 of the pole 12. The secondary hub member 30 is provided with a central cavity 32 extending axially therethrough, wherein the cavity includes a pole receiving portion 34 and a narrower upper portion 36 which extends through an interior wall 38 of the secondary hub member. The interior wall 38 maintains the hub member in position at the top end 14 of the pole 12. The hub members 18, 30 may be made of injection molded thermoplastic, such as DELRIN with TEFLON, for example, so as to resist rust, UV degradation, dry rot, and water damage. Other rigid and or flexible material may be used.

As shown in FIG. 1, a threaded bolt 15 extends from the central pole 12 through the narrow upper portion 36 of the secondary hub member central cavity 32. A nut 17 tightened about the bolt 15 is capable of maintaining the secondary hub member 30 in substantially rigid position about the pole 12. When desired, the nut 17 may be loosened so as to allow the secondary hub member to rotate about the pole axis. A finial or end cap 40 is also secured to the bolt 15 for aesthetic purposes once a canopy has been positioned atop the frame assembly. The end cap also maintains the fabric canopy in a secured central position.

As shown in FIG. 3, the main 18 and secondary 30 hub members are further provided with slots 42 formed at intervals about their respective radial edges 44. The slots 42 are three sided and include a base 46, a back wall 48, and a pair of side walls 50. The back wall faces radially outwardly from the hub members 18, 30 and the side walls extend outwardly from the slot back wall 48 at diverging angles. In one embodiment of the invention, the slots are approximately ¼ inch in depth and the slot back wall is approximately ¾ inches in width.

As shown in FIG. 3, hub connector joints 52 are insertable within the hub member slots 42 and may be secured therein by screws 54, for example. The hub connector joints may be made of injection molded thermoplastic or stamped metal, for example. The hub connector joints are provided with a base portion 56 and a pair of substantially parallel side walls 58 which define an interior aperture 60. The hub connector joints also have a back face 62 and a pair of corner walls 64 which extend outwardly from the back face 62 at diverging angles. The back face 62 and corner walls 64 mate respectively with the slot back wall 48 and slot side walls 50. Thus, the angles with which the corner walls 64 and slot side walls 50 diverge from the back face 62 and slot back wall 48, respectively, are substantially identical. In one embodiment of the invention, this angle is approximately 104 degrees. Providing the slots 42 with three walls 62, 64 and a base portion 56 ensures a snug fit of the hub connector joints within the hub member slots and helps prevent the joints 26 from twisting or displacing under stress. Further, the depth and width of the slots allow the hub connector joints to be readily secured and removed from within the slots using a screw 54, as shown in FIG. 3. While a screw member is shown as the means of attachment for the hub connector joints within the hub member slots, other forms of attachment may be employed, such as a machine threaded bolt, fitted notch or other element which allows the hub connector joints to be easily attached and removed. As shown in FIG. 3, the interior surface 66 of the hub connector joints 52 may be rounded and substantially U-shaped so as to provide clearance for rib and strut members, as described hereinafter. In the embodiment of the invention as shown in FIG. 3, the hub members 18, 30 are provided with eight slots 42 so as to accommodate up to eight hub connector joints 52. Other #'s of slots may be utilized as well.

Figure 4:
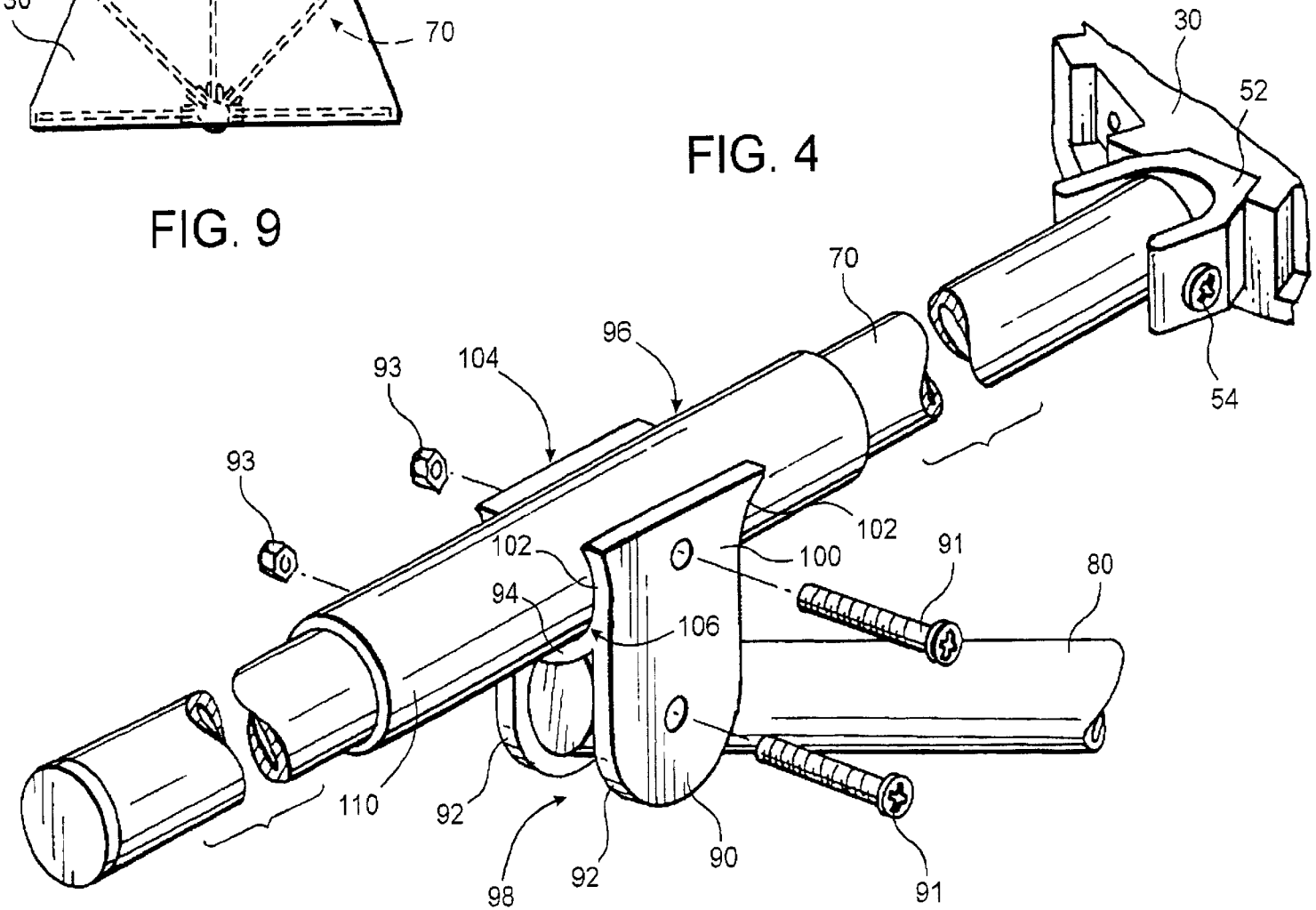
FIG. 4 is an exploded perspective view of the collar member of the present invention.

As shown in FIGS. 1, 2 and 4, rib members 70 are pivotally secured to the hub connector joints 52 of the secondary hub member 30. The rib members 70 form the outer framework of the umbrella frame of the present invention. Strut members 80 are pivotally secured at a first end 82 to the hub connector joints 52 of the main hub member 18 and are pivotally secured at a second end 84 to the rib members 70 at a point near the approximate midpoint of the rib members. The strut members 80 provide support for the rib members when the umbrella frame is in the extended or open position. Pivotal attachment of the rib and strut members to their respective hub connector joints may be exacted using a single screw 54 extending through the hub connector joint and rib or strut member, machine threaded bolt, fitted notch or other like joinery that allows the hub connector joints to be easily replaceable. The rib and strut members may be made of aluminum or wood, for example.

As shown in FIG. 4, the strut members 80 are pivotally secured to the rib members 70 by a collar member 90. The collar member 90 includes a pair of substantially parallel outer walls 92 and a central divider wall 94 which combine to define an upper channel portion 96 and a lower slot portion 98 on opposite sides of the divider wall 94. The upper portion 100 of the collar member outer walls 92 which define the channel portion 96 includes outwardly diverging side edges 102 and a substantially flat top edge 104. The channel portion 96 may have a substantially rounded interior surface 106 adapted for receiving the rib members. When the rib members are in a substantially different shade the channel portion 96 may be adapted to match shape. As shown in FIG. 4, the channel portion interior surface 106 extends around over one half the circumference of the rib member. As shown in FIG. 4, the rib members 70 may be secured within the collar member channel portion 96 by a screw 91 and nut 93. The substantially flat top edge 104 of the collar member avoids contact with the umbrella canopy which is positioned over the rib members and thereby helps prolong the life of the canopy employed. The strut members 80 are pivotally secured to the slot portion 98 of the collar member 90 by a screw 91 and nut 93, as shown in FIG. 4. Also, as shown in FIG. 4, a substantially cylindrical sleeve member 110 may be employed between the collar member 90 and the rib member 70 to reinforce the support provided by the strut member 80 to the rib member 70. In one embodiment of the invention, the sleeve member 110 is made of aluminum.

As shown in FIGS. 1 and 2, a retaining pin 112 is attached to the main hub member 18 and can be placed within a retaining pin slot 114 in the pole 12 in order to maintain the vertical position of the main hub member 18 along the pole. The pin 112 is secured to the main hub member so as to allow the free rotation of the hub members 18, 30 about the pole even when the pin 112 is in place within the pin retaining slot 114. As shown in FIGS. 1 and 2, the pin 112 is maintained around the waist portion 28 of the main hub member by a looped line 116 which allows the main hub member to rotate without binding the line. The main hub member may also be formed of two pieces and may employ ball or roller bearings or the like to allow the two pieces to move independently of one another in a lateral direction, while still moving as a single unit up and down the pole. Such an arrangement allows the retaining pin to remain within its slot and thereby maintain the main hub member in the upper, frame extended, position while allowing the umbrella canopy frame assembly to be freely rotated about the pole axis.

Figure 9:
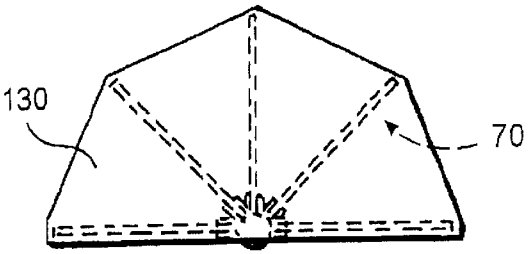
FIGS. 5 through 9 are top schematic views showing examples of different canopy shapes which may be employed with the present invention.
Figure 5:
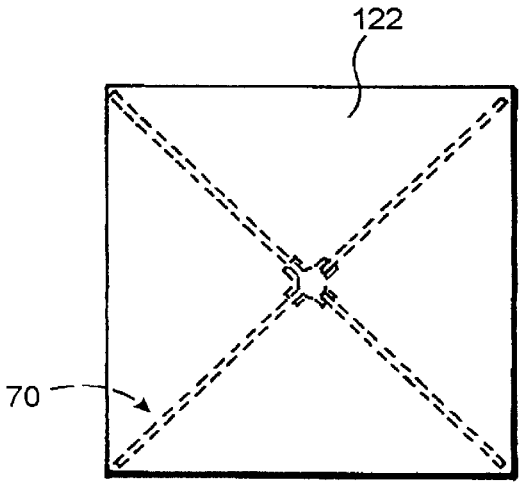
Figure 6:
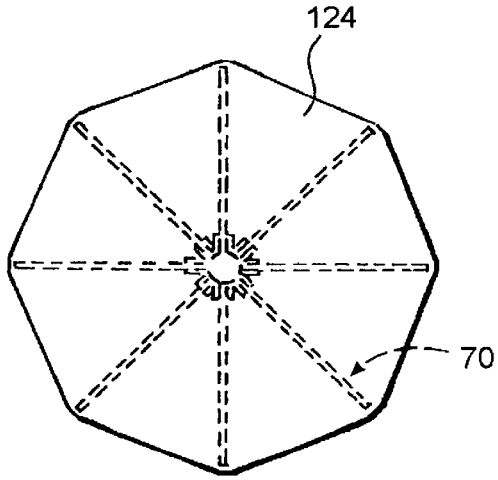
Figure 7:
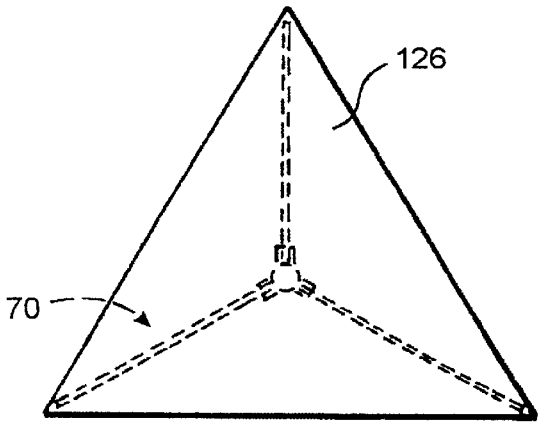
Figure 8:
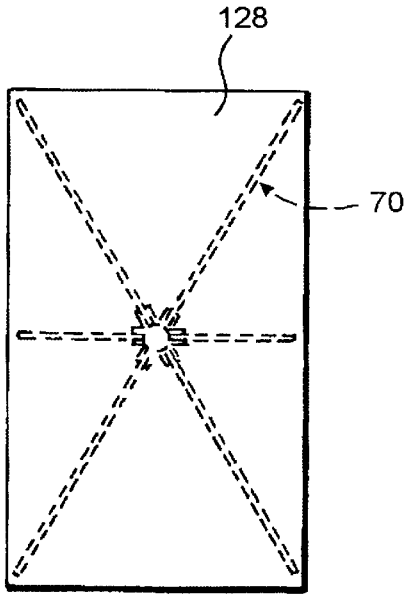

In operation, any desired number and size of rib and strut members may be employed, depending on the particular size and shape of the umbrella canopy to be attached. Because the hub connector joints and collar members are so easily installed, many different configurations of the canopy can be achieved with little effort by either increasing or decreasing the number of hub connector joints present on the hub members. For example, as shown in FIGS. 5 through 9, four rib members 70 are employed for the square shaped canopy 122 (FIG. 5), eight rib members 70 are employed for the octagonal shaped canopy 124 (FIG. 6), three rib members 70 are employed for the triangular shaped canopy 126 (FIG. 7), six rib members 70 are employed for the rectangular shaped canopy 128 (FIG. 8) and five rib members 70 are employed for the semi-octagonal shaped canopy 130 (FIG. 9). The number of ribs to be employed determines the number of strut members, hub connector joints, and collar members to be employed. For example, with four rib members, four strut members, eight hub connector joints, and four collar members are employed. For proper operation, the hub connector joints must be secured within corresponding slots in the main and secondary hub members. Other geometrical shapes and sizes of canopies may also be employed using the frame assembly of the present invention.

Canopies of varying shapes and sizes are attached to the umbrella frame by unscrewing the finial or end cap 40 from the top end 14 of the pole 12 and removing the securing nut 17. The canopy opening is placed over the threaded bolt 15 and the canopy cuffs are placed around the outer ends of the rib members. The securing nut 17 and finial 40 are then placed back onto the threaded bolt 15. In one embodiment of the invention, the canopy members are SUNBRELLA 100% solution-dyed acrylic canopies or any other shade-like or non-shadelike material.

When the frame is in the retracted position, as shown in phantom in FIGS. 1 and 2, the main hub member 18 is near the bottom end 16 of the pole. As the main hub member 18 is lifted up the pole, the strut members 80 extend outwardly, thereby expanding the rib members 70 and opening the attached canopy 21. As the strut members 80 pass the point where they extend perpendicularly from the pole member 12, the strut members 80 lock into place against a hub stop member 120 secured to the pole, as shown in solid lines in FIGS. 1 and 2. The retaining pin member 112 is then placed within its slot 114 on the pole and the hub member 18 may then be returned downwardly to rest against the pin member 112. In this position, as shown in the dashed lines in FIGS. I and 2, the strut members 80 extend in a substantially perpendicular fashion from the pole member 12 to provide substantial support to the rib members 70.

The hub connector joints 52 and the collar members 90 are of key importance in the structural and long term integrity of the umbrella unit. First, the upper portion 100 of the collar member walls 92 remain below the height of the rib members; thus, the collar members 90 avoid contacting the canopy during operation of the umbrella. Such contact could significantly damage the fabric of the canopy. Secondly, the collar members 90 and the hub connector joints 52 help maintain the rib and strut members in perfect alignment so that the two independent hubs act in concert throughout the continual opening and closing of the umbrella frame. The upper channel portions 96 of the collar members 90 cradle the rib members 70 and the slot portions 98 of the collar members as well as the hub connector joint apertures 60 straddle their respective ends of the rib 70 and strut 80 members and allow ease of pivotal motion. Due to the interchangeable and easily replaceable nature of the hub connector joints and collar members, a broken umbrella may be repaired quickly, easily and with minimal cost to the consumer. Different textures and colors of the hub members, the hub connector joints, and the collar members are also available.

The umbrella frame may be easily rotated by loosening the end cap 40 and securing nut 17 from the pole top end 14 and rotating the hub members 18, 30 to their desired location. The umbrella frame may also employ a double pulley system 45 as shown in FIG. 2, to allow the user to pull the pulley cord 47 to initiate the raising of the main hub member and thereby the opening of the umbrella.

The rigidity and density of all the components described herein can be tempered for a desired flexibility as needed. The pole, rib, and strut members may be comprised of metal, wood or fiberglass but not limited to these rigid compositions. The nature of thermoplastic construction with materials like ABS, DELRIN, POLYPROPOLYNE and other ACETALS allow for a degree of flexibility in the hubs, hub connector joints, and collar members of the umbrella frame. In heavy wind conditions the static frame work moves a few degrees in many directions and the tension of this movement is absorbed but not released. This type of stress over time degrades the structural integrity of an umbrella. Because these plastics have a degree of flexibility, the energy that normally would be absorbed by a completely static frame umbrella is distributed through all of the plastic components of the umbrella. This greatly increases the life of the static frame of an outdoor umbrella which is generally the more costly portion of an umbrella unit.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An umbrella frame comprising:

a central pole member having a longitudinal axis, a bottom end and a top end, a main hub member secured about said central pole member, said main hub member capable of sliding between said bottom and top ends, said main hub member also having a radial edge with a plurality of slots formed at intervals thereabout, a secondary hub member secured to said pole member near said pole top end, said secondary hub member having a radial edge with a plurality of slots formed at intervals thereabout, a plurality of hub connector joints, each of said hub connector joints being fixedly yet removably secured within a respective one of said main and said secondary hub member slots, a plurality of rib members, each of said rib members being pivotally secured to a respective one of said hub connector joints of said secondary hub member, and a plurality of strut members each having an inner end and an outer end, said inner end of each of said strut members being pivotally secured to a respective one of said hub connector joints of said main hub member, said outer end of each of said strut members being pivotally secured to a respective one of said rib members.

2. The umbrella frame of claim 1 wherein each of said slots has a base, a back wall and a pair of side walls.

3. The umbrella frame of claim 2 wherein said slot back walls face radially outwardly from said hub members.

4. The umbrella frame of claim 2 wherein, for each slot, said slot side walls extend outwardly from said slot back wall at diverging angles.

5. The umbrella frame of claim 1 wherein each of said hub connector joints has a pair of corner walls and a back wall, said corner walls extending from said back wall at diverging angles.

6. The umbrella frame of claim 1 wherein each of said hub connector joints includes a base and a pair of substantially parallel side walls which define an interior aperture.

7. The umbrella frame of claim 6 wherein each of said hub connector joints further includes a pair of corner walls and a back wall, said corner walls extending from said back wall at diverging angles.

8. The umbrella frame of claim 1 wherein each of said hub connector joints has an interior surface which is substantially U-shaped.

9. The umbrella frame of claim 1 wherein said hub members are rotatable about said pole axis.

10. The umbrella frame of claim 1 wherein each of said hub members is provided with eight slots.

11. The umbrella frame of claim 1 wherein said main hub member includes upper and lower portions and a central waist portion, said waist portion being of smaller diameter than said upper and lower portions.

12. The umbrella frame of claim 1 wherein said strut members are pivotally secured to said rib members by collar members, each of said collar members including a pair of substantially parallel outer walls and a central divider wall, said walls forming an upper channel portion on one side of said divider wall and a lower slot portion on the opposite side of said divider wall.

13. The umbrella frame of claim 12 wherein said channel portion has a substantially rounded interior surface.

14. The umbrella frame of claim 12 wherein said collar member outer walls have an upper portion which includes outwardly diverging side edges and a substantially flat top edge.

15. The umbrella frame of claim 13 wherein said collar member interior surface extends around over one-half the circumference of its respective rib member.

16. The umbrella frame of claim 14 further including a plurality of substantially cylindrical sleeve members, each of said sleeve members extending about a portion of a respective one of said rib members, and wherein each of said sleeve members is secured within said channel portion of a respective one of said collar members.

17. The umbrella frame of claim 1 further including pulley means for raising and lowering said main hub member.

18. An umbrella frame comprising:

a central pole member having a longitudinal axis, a bottom end and a top end, a main hub member secured about said central pole member, said main hub member capable of sliding between said bottom end and said top end, a secondary hub member secured to said pole member near said pole top end, said main hub member and said secondary hub member including a plurality of hub connector joints removably secured to the respective hub members, each of said hub connector joints having an interior surface which is substantially U shaped, a plurality of rib members, each of said rib members being pivotally secured within a respective one of said hub connector joints of said secondary hub member, a collar member secured to each of said rib members, and a plurality of strut members each having an inner end and an outer end, said inner end of each of said strut members being pivotally secured within a respective one of said hub connector joints of said main hub member, said outer end of each of said strut members being pivotally secured to a respective one of said collar members.

19. The umbrella frame of claim 18 wherein said collar member includes a pair of substantially parallel outer walls and a central divider wall, said walls forming an upper channel portion on one side of said divider wall and a lower slot portion on the opposite side of said divider wall.

20. The umbrella frame of claim 18 further including a plurality of substantially cylindrical sleeve members, each of said sleeve members extending about a portion of a respective one of said rib members, and wherein each of said sleeve members is secured within said channel portion of a respective one of said collar members.

21. An umbrella frame comprising:

a central pole member having a longitudinal axis, a bottom end and a top end;

said pole member including a bolt extending from said top end and also having a retaining pin slot formed on pole member;

an upper hub member supported on said pole member near said pole top end, said upper hub member including a pole receiving portion and an upper portion with a central cavity extending axially through said upper portion; said bolt extending outwardly through said central cavity of said upper portion and said top end of said central pole member engaging said upper portion such that said upper hub member is capable of rotating about said central pole axis;

a main hub member secured about said central pole member, said main hub member capable of sliding between said bottom and top ends, said main hub member including a central cavity sized and structured to permit rotation of said main hub member about said central pole axis;

a plurality of rib members pivotally secured to said upper hub member, a plurality of strut members each having an inner and an outer end, said inner ends being pivotally secured to said main hub member, said outer end of each of said strut members being pivotally secured to a respective one of said rib members, a pin member extendable within said retaining pin slot for maintaining said main hub member in position along the pole member, and means for securing said pin member to said main hub member so as to allow said umbrella frame to rotate freely about said pole member when said pin member is placed within said retaining pin slot.

22. The umbrella frame of claim 21 wherein said main hub member has upper and lower portions and a central waist portion, said waist portion being of smaller diameter than said upper and lower portions, and wherein said securing means includes a line encircling said waist portion and secured to said pin member.

* * * * *